US008061265B2

(12) United States Patent
Cambay

(10) Patent No.: US 8,061,265 B2
(45) Date of Patent: Nov. 22, 2011

(54) CONSTRUCT FOR HEATING A ROUNDED FOOD ITEM IN A MICROWAVE OVEN

(75) Inventor: Jean-Michel Cambay, Caullery (FR)

(73) Assignee: Graphic Packaging International, Inc., Marietta, GA (US)

( * ) Notice: Subject to any disclaimer, the term of this patent is extended or adjusted under 35 U.S.C. 154(b) by 765 days.

(21) Appl. No.: 11/891,461

(22) Filed: Aug. 10, 2007

(65) Prior Publication Data

US 2009/0050520 A1 Feb. 26, 2009

Related U.S. Application Data

(60) Provisional application No. 60/920,334, filed on Mar. 27, 2007.

(30) Foreign Application Priority Data

Aug. 11, 2006 (EP) ..... 06291318

(51) Int. Cl.
*A21B 3/13* (2006.01)

(52) U.S. Cl. ..... 99/324; 206/784

(58) Field of Classification Search ..... 99/646; 156/630, 634, 656, 659.1, 665
See application file for complete search history.

(56) References Cited

U.S. PATENT DOCUMENTS 2,153,340 A * 4/1939 Reid ..... 229/102
3,865,301 A * 2/1975 Pothier et al. ..... 229/5.82
4,425,368 A 1/1984 Watkins
4,775,771 A 10/1988 Pawlowski
4,865,921 A 9/1989 Hollenberg
4,890,439 A 1/1990 Smart
4,936,935 A 6/1990 Beckett
4,963,424 A 10/1990 Beckett
5,093,364 A 3/1992 Richards et al.
5,117,078 A 5/1992 Beckett
5,197,598 A 3/1993 Stout et al.
5,213,902 A 5/1993 Beckett
5,221,419 A * 6/1993 Beckett ..... 216/33
5,260,537 A 11/1993 Beckett
5,266,386 A 11/1993 Beckett
RE34,683 E 8/1994 Maynard
5,340,436 A 8/1994 Beckett
5,354,973 A 10/1994 Beckett
5,410,135 A 4/1995 Pollart
5,424,517 A 6/1995 Habeger
5,519,195 A 5/1996 Keefer (Continued)

FOREIGN PATENT DOCUMENTS

DE 200 13 726 U1 12/2000

(Continued)

OTHER PUBLICATIONS

PCT/US2007/075679—International Search Report.

(Continued)

*Primary Examiner* — Henry Yuen
*Assistant Examiner* — Thien Tran
(74) *Attorney, Agent, or Firm* — Womble Carlyle Sandridge & Rice, LLP

(57) ABSTRACT

A carton includes inclined end panels that bring microwave susceptor heating materials at the carton ends into close proximity with an article accommodated within the carton. The carton is of relatively simple construction and may be stacked with other cartons.

24 Claims, 10 Drawing Sheets

U.S. PATENT DOCUMENTS

| | | | | |
|---|---|---|---|---|
| 5,628,921 | A | 5/1997 | Beckett | |
| 5,672,407 | A | 9/1997 | Beckett | |
| 5,759,422 | A | 6/1998 | Schmelzer | |
| 5,800,724 | A | 9/1998 | Habeger | |
| 6,114,679 | A | 9/2000 | Lai | |
| 6,150,646 | A | 11/2000 | Lai | |
| 6,204,492 | B1 | 3/2001 | Zeng | |
| 6,251,451 | B1 | 6/2001 | Zeng | |
| 6,414,290 | B1 | 7/2002 | Cole | |
| 6,433,322 | B2 | 8/2002 | Zeng | |
| 6,455,827 | B2 | 9/2002 | Zeng | |
| 6,552,315 | B2 | 4/2003 | Zeng | |
| 6,677,563 | B2 | 1/2004 | Lai | |
| 6,717,121 | B2 | 4/2004 | Zeng | |
| 6,765,182 | B2 | 7/2004 | Cole | |
| 7,019,271 | B2 | 3/2006 | Wnek | |
| 2004/0000494 | A1* | 1/2004 | Sutherland | 206/140 |
| 2004/0055257 | A1* | 3/2004 | Parrotta et al. | 53/456 |
| 2005/0269387 | A1* | 12/2005 | Sutherland | 229/103.2 |
| 2006/0049190 | A1 | 3/2006 | Middleton et al. | |
| 2006/0113300 | A1 | 6/2006 | Wnek | |
| 2006/0289521 | A1 | 12/2006 | Bohme | |

FOREIGN PATENT DOCUMENTS

| | | | |
|---|---|---|---|
| DE | 202005008561 | | 9/2005 |
| FR | 2 471 923 | | 6/1981 |
| JP | 10139033 | | 5/1998 |
| JP | 2006-021778 | * | 1/2006 |
| WO | WO 03/066435 | | 8/2003 |
| WO | 2006021778 | | 1/2006 |

OTHER PUBLICATIONS

PCT/US2007/075679—Written Opinion.

* cited by examiner

CONSTRUCT FOR HEATING A ROUNDED FOOD ITEM IN A MICROWAVE OVEN

CROSS-REFERENCE TO RELATED APPLICATIONS

This application claims the benefit of U.S. Provisional Application No. 60/920,334, filed Mar. 27, 2007, and claims priority to European Patent Application No. 06291318.1, filed Aug. 11, 2006, both of which are incorporated by reference herein in their entirety.

TECHNICAL FIELD

The present invention relates to various blanks, constructs, and methods for heating, browning, and/or crisping a food item, and particularly relates to various blanks, constructs, and methods for heating, browning, and/or crisping a food item in a microwave oven.

BACKGROUND

Microwave ovens have become a principle form of heating food in a rapid and effective manner. Various attempts have been made to provide microwave food packages that produce effects associated with foods cooked in a conventional oven. Such packages generally must be capable of controlling the distribution of energy around the food item, utilizing the energy in the most efficient manner, and ensuring that the food item and the container provide a pleasant and acceptable finished food item. For example, where browning and/or crisping of the food item is desired, such packages often include one or more microwave energy interactive elements that convert microwave energy into thermal energy, thereby intensifying the heating of the surface of the food item. Typically, relatively close proximity between the food item and the microwave energy interactive element is needed to achieve the desired browning and/or crisping. When the food item to be browned and/or crisped has a rounded or irregular shape, for example, in the case of a baguette or other roll, package design is complicated further. Thus, there remains a need for a microwave energy interactive construct that provides the desired level of heating, browning, and/or crisping of rounded or irregular food items in a microwave oven.

SUMMARY

The present invention relates generally to various blanks, constructs formed from such blanks, and methods of heating, browning, and/or crisping a food item in a microwave oven. The blanks of the present invention include a plurality of adjoined panels that may be used to form various constructs for heating a food item having a somewhat rounded or irregular shape. If desired, the blanks and/or constructs of the invention may include one or more microwave energy interactive elements that enhance the heating, browning, and/or crisping of the food item. The various constructs bring the microwave energy interactive element into proximate or intimate contact with the food item to be heated, for example, dough-based items such as rolls, breads, and pastries, filled items such as burritos, sandwiches, and meat pies, or any other item as desired.

The various constructs of the invention may be of relatively simple construction, may be erected in relatively few steps, and may be stackable with other constructs. For example, the ends of the construct may be closed by a relatively simple mechanical closure mechanism. The structure of the construct may be such that the food item contained within the construct is not subjected to undue loads during stacking, transport, or use.

In one particular aspect, a blank according to the invention comprises a top panel having a first dimension extending along a first direction and a second dimension extending along a second direction, a first end panel and a second end panel foldably joined to the top panel along the first direction, a first side panel and a second side panel foldably joined to the top panel along the second direction, a plurality of corner closures including a first corner closure extending between the first end panel and the first side panel, and at least one bottom panel foldably joined to at least one of the side panels. The first direction is substantially perpendicular to the second direction. Each corner closure may comprise a first tuck-in panel and a second tuck-in panel defined by a plurality of oblique fold lines extending away from the top panel towards a periphery of the blank.

In one variation, the bottom panel has a first dimension extending along the first direction and a second dimension extending along the second direction, the first dimension of the bottom panel is substantially equal to the first dimension of the top panel, and the first dimension of the bottom panel is greater than the second dimension of the top panel.

In another variation, the bottom panel is joined foldably to the first side panel, and an adhesive panel is joined foldably to the second side panel.

The blank may include an aperture, for example, a venting aperture. In one example, the blank includes a plurality of apertures extending through the blank. At least one of the apertures may be positioned at an intersection of the top panel, the first end panel, and the first side panel.

If desired, the blank may include a microwave energy interactive element overlying at least a portion of at least one of the top panel, the first end panel, the second end panel, the first side panel, the second side panel, the first tuck-in panel, and the second tuck-in panel. The microwave energy interactive element may be a susceptor, a segmented metal foil, a metal foil patch, a microwave energy interactive insulating material, or any combination thereof. In one example, the microwave energy interactive element comprises a susceptor, and the susceptor overlies at least a portion of the top panel and the bottom panel. In another example, the microwave energy interactive element comprises a susceptor, and the susceptor overlies at least a portion of the top panel, end panels, side panels, and bottom panel.

In another particular aspect of the invention, a construct for receiving a food item comprises a top panel, a first side panel, a second side panel, a bottom panel, a first end closure at a first end of the construct, and a second end closure at a second end of the construct. The first end closure may include a first upper end panel disposed at an acute angle of inclination with respect to the bottom panel, and a pair of corner closures foldably connected to respective opposed sides of the first upper end panel and the first side panel and the second side panel, respectively.

In one variation, each corner closure comprises a pair of tuck-in panels and the tuck-in panels are folded in an overlapping configuration.

In another variation, the first side panel is connected to one of the corner closures along an edge of the first side panel, and the edge of the first side panel has an angle of inclination that generally conforms with the angle of inclination of the first upper end panel.

In yet another variation, the first end closure further comprises a first lower end panel foldably connected to a lower edge of the first upper end panel.

In still another variation, the first end closure comprises a first closure flap foldably connected to the first lower end panel. A first pair of closure tabs at the first end of the construct may engage the first closure flap to maintain the first end closure in a closed state.

In a further variation, the second end closure may comprise a second upper end panel, a pair of corner closures foldably connected to respective opposed sides of the second upper end panel, and a second lower end panel foldably connected to a lower edge of the second upper end panel. The corner closures may be foldably connected to one of the side panels. Each corner closure may comprise a pair of tuck-in panels folded over onto one another.

If desired, a microwave energy interactive element may cover or overlie at least a portion of at least one of the top panel, first side panel, second side panel, and bottom panel. The microwave energy interactive element may include a susceptor, a segmented metal foil, a metal foil patch, a microwave energy interactive insulating material, or any combination thereof.

In a further aspect of the invention, a construct for receiving a food item comprises a top panel having a pair of opposed ends, a first upper end panel and a second upper end panel respectively extending obliquely from opposed ends of the top panel, a first lower end panel foldably connected to the first upper end panel, a second lower end panel foldably connected to the second upper end panel, a first closure flap foldably connected to the first lower end panel, and a second closure flap foldably connected to the second lower end panel. The first lower end panel and the first closure flap may form at least a portion of a first end closure at a first end of the construct. The second lower end panel and the second closure flap may form at least a portion of a second end closure at a second end of the construct.

The top panel, first upper end panel, second upper end panel, first lower end panel, and second lower end panel may define at least a portion of an interior surface of the construct. A microwave energy interactive element may overlie and/or define at least a portion of the interior surface.

The construct may further comprise a bottom panel, a first side panel, and a second side panel. A microwave energy interactive element may overlie at least a portion of at least one of the top panel, the bottom panel, the first side panel, and the second side panel.

In one variation, the construct includes a corner closure extending from an edge of the first end panel. The corner closure may include a first tuck-in panel and a second tuck-in panel defined by a plurality of oblique fold lines extending away from the top panel. In another variation, the corner closure is a first corner closure, the edge of the first end panel is a first edge of the first end panel, and the construct further comprises a second corner closure extending from a second edge of the first end panel opposite the first edge of the first end panel.

Other features, aspects, and embodiments will be apparent from the following description and accompanying figures.

BRIEF DESCRIPTION OF THE DRAWINGS

The description refers to the accompanying drawings, some of which are schematic, in which like reference characters refer to like parts throughout the several views. According to common practice, the various features of the drawings discussed below are not necessarily drawn to scale. Dimensions of various features and elements in the drawings may be expanded or reduced to illustrate the invention more clearly.

DETAILED DESCRIPTION

The present invention may be illustrated further by referring to the figures. For simplicity, like numerals may be used to describe like features. It will be understood that where a plurality of similar features are depicted, not all of such features necessarily are labeled on each figure. It also will be understood that various components used to form the blanks and constructs of the present invention may be interchanged. Thus, while only certain combinations are illustrated herein, numerous other combinations and configurations are contemplated hereby.

Figure 1A:
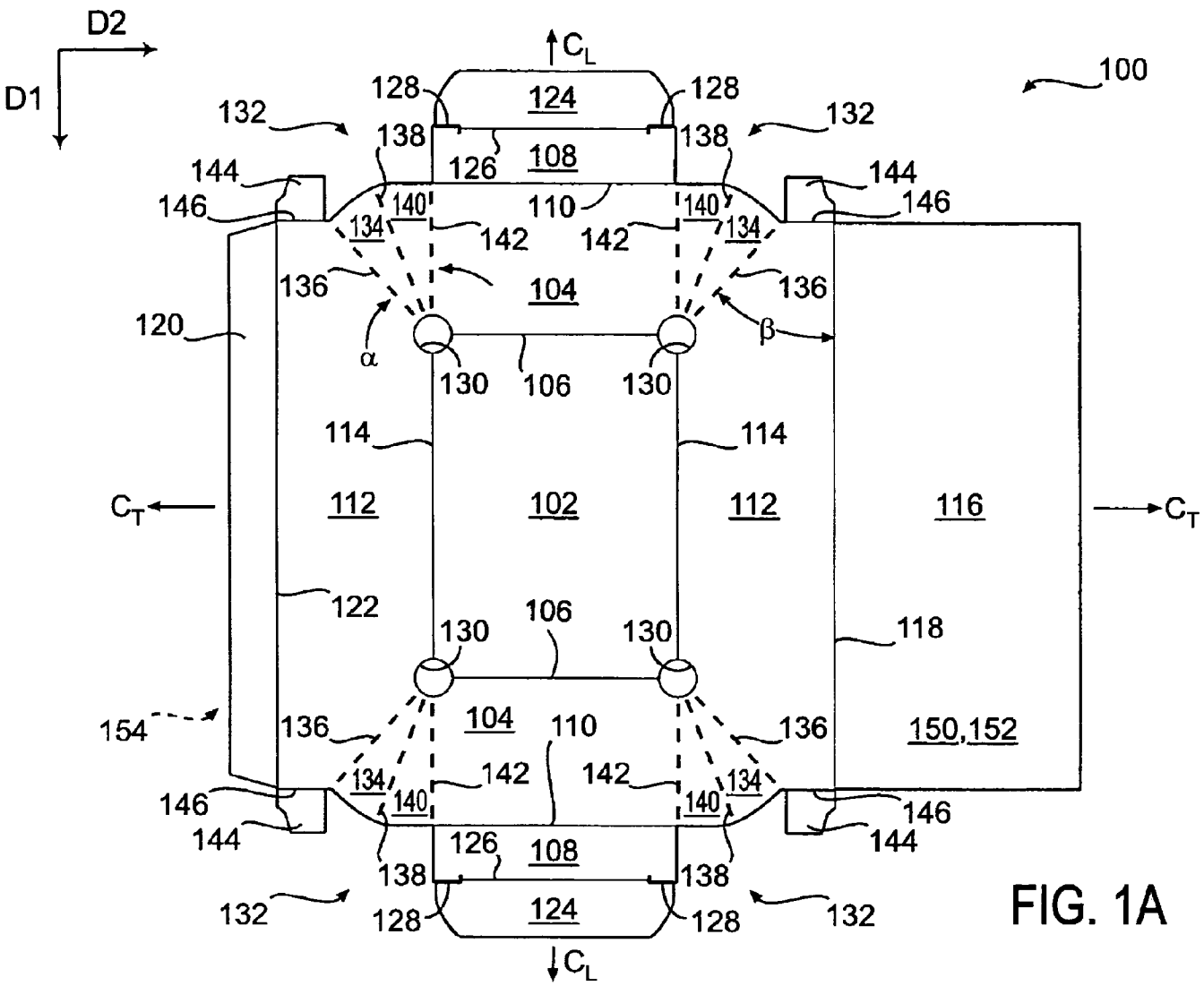
FIG. 1A is a schematic top plan view of a first side of a blank used to form a construct according to various aspects of the invention.

FIG. 1A depicts an exemplary blank 100 according to various aspects of the invention. The blank 100 includes a plurality of adjoined panels. In this and other examples of the invention discussed herein and/or contemplated hereby, each of the various panels and the blank generally has a first dimension, for example, a length, extending in a first direction, for example, a longitudinal direction, D1, and a second dimension, for example, a width, extending in a second direction, for example, a transverse direction, D2. The blank 100 may be symmetric or partially symmetric about a longitudinal center line $C_L$ and about a transverse center line $C_T$. Therefore, certain elements in the drawing figures may have similar or identical reference numerals in order to reflect the whole or partial longitudinal and transverse symmetries. It will be understood that such directional designations are made only for convenience and do not necessarily refer to or limit the manner in which the blank is manufactured or erected into a construct.

Still viewing FIG. 1A, the blank 100 includes a top panel 102 foldably connected to first and second upper end panels 104 at transverse fold lines 106, first and second lower end panels 108 foldably connected to the upper end panels 104 along transverse fold lines 110, first and second side panels 112 foldably connected to the top panel 102 along longitudinal fold lines 114, and a base or bottom panel 116 foldably connected to one of the side panels 112 along a longitudinal fold line 118. An adhesive panel 120 may be connected foldably to the other side panel 112 along a longitudinal fold line 122.

Each of the first and second lower end panels 108 may be connected foldably to an end closure flap 124 along a transverse fold line 126. Ell-shaped closure cuts 128 may be formed at each end of the fold lines 126. Apertures 130 may be formed at one or more corners of the top panel 102. In this example, the blank 100 includes four apertures 130 at the corners of the top panel 102. However, it will be understood that the number, shape, spacing, and positioning of the apertures may vary depending on the food item to be heated and the desired degree of browning and crisping, as will be discussed further below.

Corner closures 132 may be located at each corner of the top panel 102. Each corner closure 132 comprises a first tuck-in panel 134 defined by oblique fold lines 136, 138, and a second tuck-in panel 140 defined by an oblique fold line 138 and a longitudinal fold line 142. Fold lines 142, 136 define the corner closures 132 and form an acute angle $\alpha$ (e.g., an oblique angle). Fold lines 118, 136 define a complementary acute angle $\beta$ (e.g., an oblique angle). The angle $\beta$ approximately defines the angle of inclination of the upper end panels 104, as discussed in further detail below. The tuck-in panels 134, 140 have a generally triangular or pie shape. Each corner closure 132 connects the upper side edges of an adjacent side panel 112 and upper end panel 104. Closure tabs 144 may be connected foldably to each end of each side panel 112 at a transverse fold line 146. The closure tabs 144 engage the closure flaps 124 in the vicinity of the closure cuts 128 to close the ends of the carton 148 (best seen in FIGS. 1G and 1H).

If desired, a microwave energy interactive element, indicated generally at 150, may overlie at least a portion of the blank 100 to define at least a portion of a first surface or food-contacting surface 152. The blank 100 also includes a second surface (i.e., the side hidden from view in FIG. 1A), indicated generally at 154. In one example, the microwave energy interactive element comprises a susceptor. However, other microwave energy interactive elements, such as those described below, are contemplated for use with the invention. As will be discussed below, when the blank 100 is formed into a construct, for example, a carton 148, the first surface 152 forms the interior surface of the carton 148, and the second surface 154 forms the exterior surface of the carton 148.

Figure 1B:
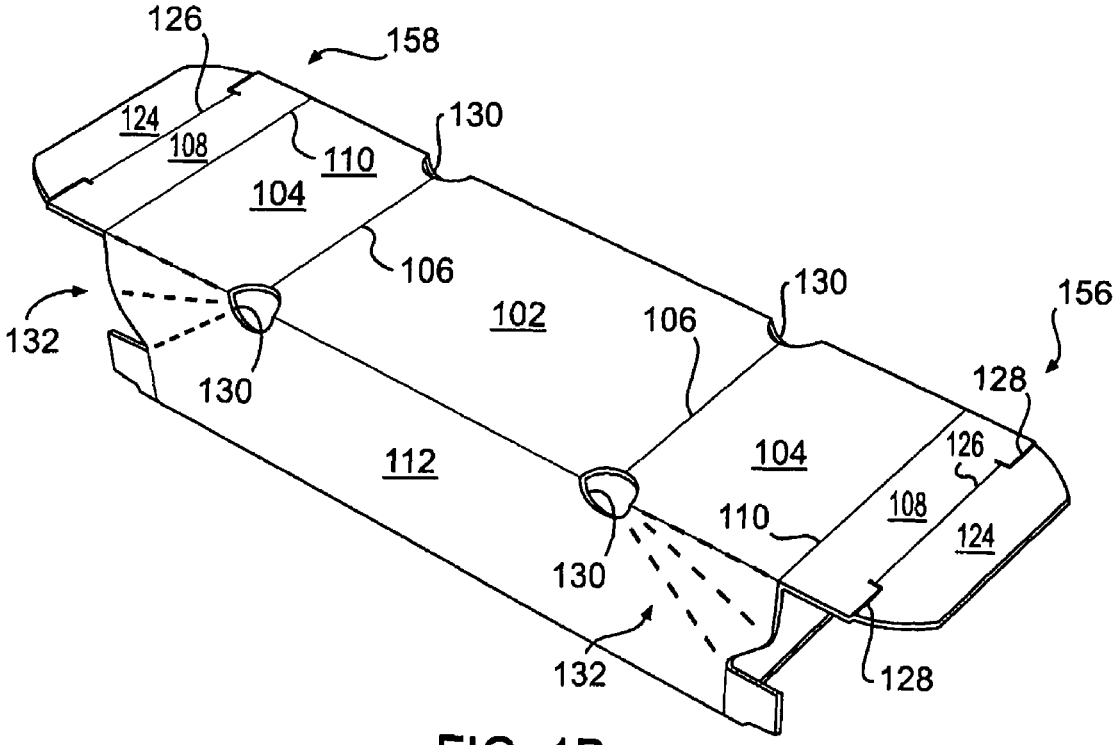
FIGS. 1B-1F schematically illustrate exemplary steps in forming a construct from the blank of FIG. 1A, according to various aspects of the invention.

FIGS. 1B-1H schematically illustrate an exemplary sequence or method of forming a construct 148 from the blank 100 of FIG. 1A. However, it will be understood that numerous other sequences and methods for forming a construct from the blank are contemplated hereby. First, the blank 100 is folded along fold lines 114 and 118, and the bottom panel 116 is overlapped with and joined to adhesive panel 120, such that the exterior surface of the adhesive panel 120 is in contact with the interior surface of the bottom panel 116. In this configuration, the blank 100 is partially assembled into a construct 148 and has a generally tubular form, as shown in FIG. 1B.

Figure 1C:
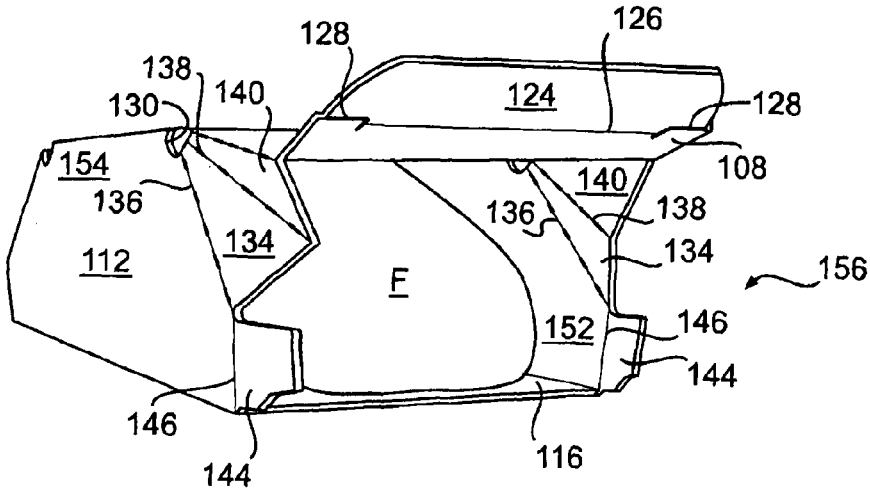
Figure 1D:
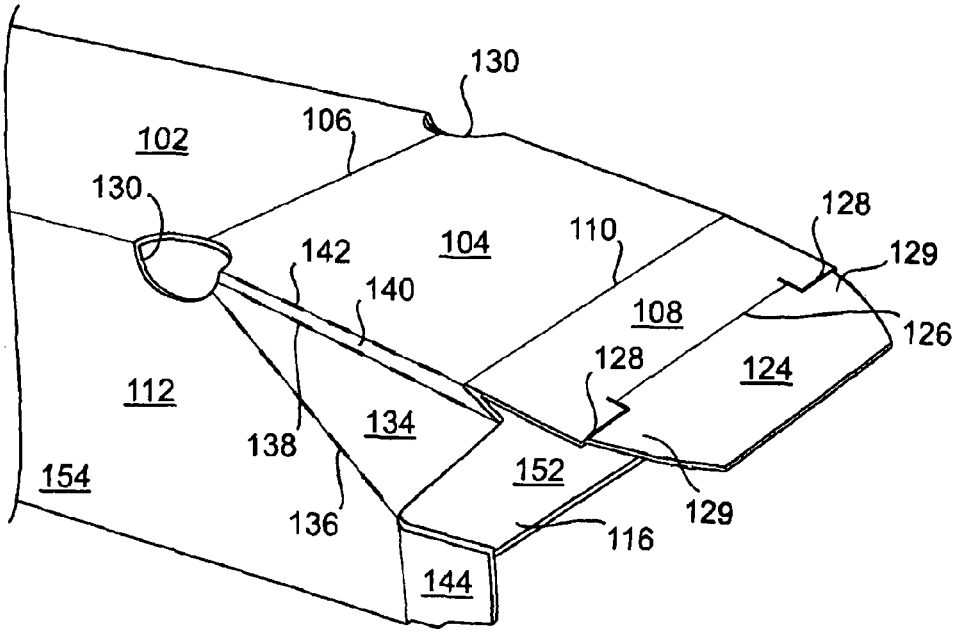

Next, a first end 156 of the tubular assembly is closed by folding the tuck-in panels 134, 140 inwardly along fold lines 136, 138, and 142, as shown in FIGS. 1C and 1D. The upper end panel 104 is pivoted downwardly over the open end 156. The placement of the apertures 130 at the corners of the top panel 102 may reduce the force required to pivot the upper end panel 104 toward its closed position.

If desired, one or more food items F can be loaded into the partially formed construct at this time, or at any time before closing both ends 156, 158 of the construct. In this example, the food item F is a baguette or other dough-based food item. However, it will be understood that the various blanks and constructs of the invention may be used with numerous different food items including, but not limited to, egg rolls, spring rolls, taquitos, burritos, sandwiches, pizzas, French fries, soft pretzels, pizza bites, cheese sticks, pastries, doughs, and so forth.

Figure 1E:
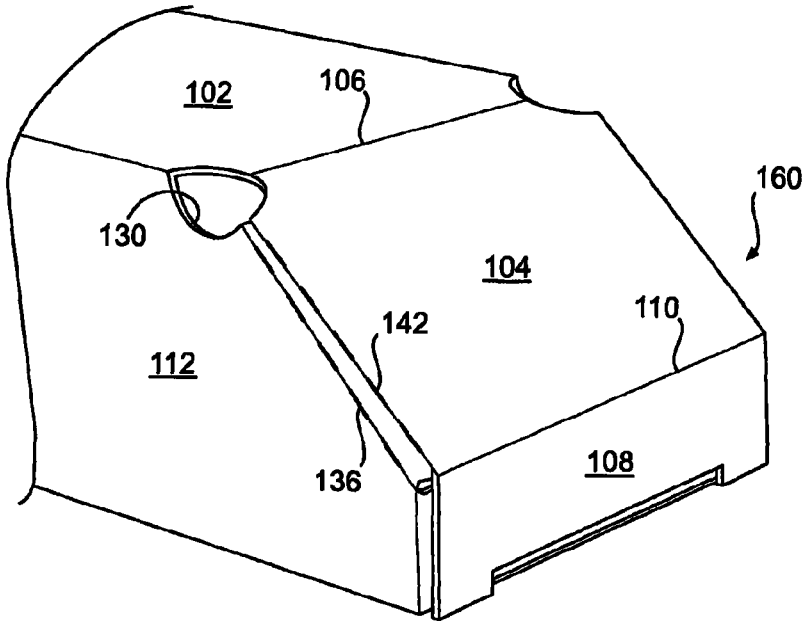

Next, closure tabs 144 are folded inwardly along fold lines 146 and upper end panels 104 are urged downwardly until the tuck-in panels 134, 140 are pressed together. If desired, glue or another adhesive material may be applied to the exterior side of either or tuck-in both panels 134, 140 so they adhere together. The lower end panel 108 is folded downwardly along fold line 110 and the closure flap 124 is folded inwardly along fold line 126. The ends 129 of the closure flap 124 are free along the closure cuts 128. The closure flap 124 is inserted into a space between the bottom panel 116 and the bottom edges of the tabs 144. As a result, the free ends 129 of the closure flap 124 engage the interior sides of the closure tabs 144, thereby securing the ends 156 in a closed configuration, as shown in FIGS. 1E and 1F.

Figure 1F:
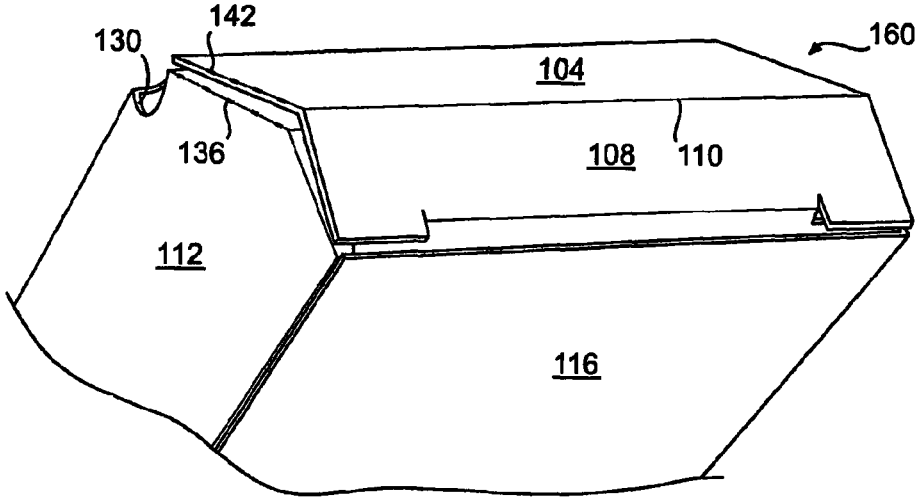
Figure 1G:
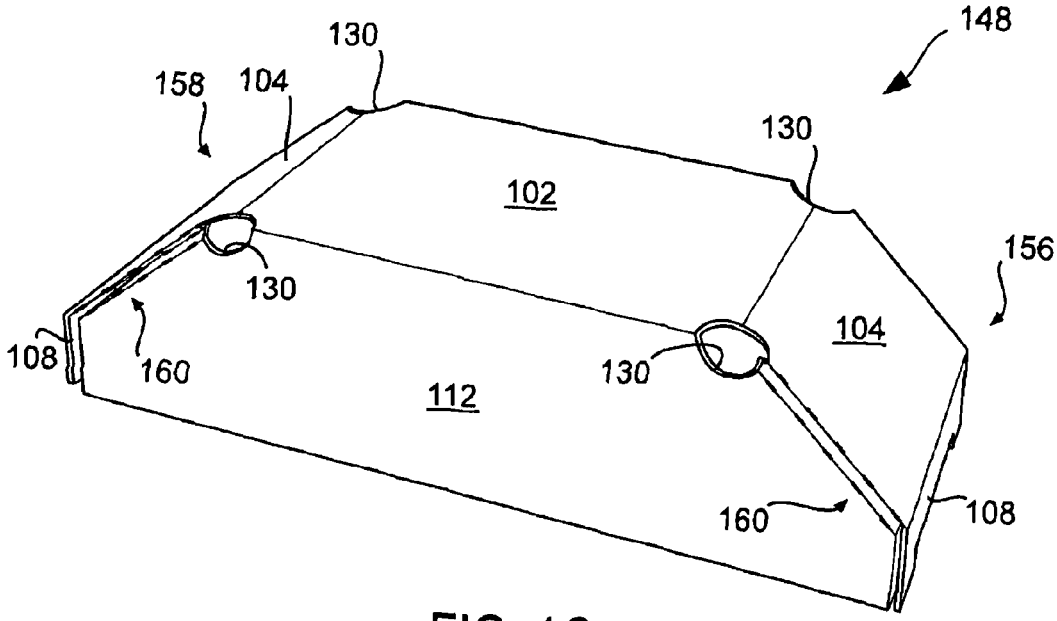
FIG. 1G is a schematic perspective view of an exemplary construct formed from the blank of FIG. 1A.

This process can be repeated for the second end 158 to form the fully erected construct 148, as shown in FIGS. 1F and 1G. An end closure 160 is formed at each end of the construct 148 by an upper end panel 104, a lower end panel 108, a closure flap 124, and the corner closures 132 on either side of the upper end panel 20. The end closures 160 may be secured with an adhesive or mechanical fastener if desired. Furthermore, the construct 148 may be enclosed with a polymer film overwrap to seal the construct hermetically.

The construct 148 has the general shape of a three-dimensional trapezoidal block with planar top and bottom panels that facilitate stacking of one or more constructs or other items without causing the food item therein to bear an unacceptable vertical load. The shape of the carton 148 may be selected to conform relatively closely to a food item F (not visible in FIGS. 1G and 1H) contained therein. For example, as shown in FIG. 1C, the food item F has tapered, rounded ends. The angle of inclination $\beta$ of the upper end panels 108 may be selected to bring the susceptor material on the interior surfaces of the upper end panels 108 into intimate or proximate contact with the tapered ends of the food item F.

Numerous other blanks and constructs are contemplated by the invention. Likewise, numerous materials may be suitable for use in forming the various blanks and constructs of the invention, provided that the materials are resistant to softening, scorching, combusting, or degrading at typical microwave oven heating temperatures, for example, at from about 250° F. to about 425° F. The particular materials used may include microwave energy interactive materials and microwave energy transparent or inactive materials.

For example, any of the various constructs of the present invention may include one or more features that alter the effect of microwave energy during the heating or cooking of the food item. For instance, the construct may include one or more microwave energy interactive elements (hereinafter sometimes referred to as "microwave interactive elements") that promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item.

The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs may be referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric vehicle or other suitable matrix or binder, and may include flakes of an electroconductive metal, for example, aluminum.

In one example, the microwave interactive element may comprise a thin layer of microwave interactive material (generally about 60 to 100 angstroms thick) that tends to absorb microwave energy, thereby generating heat at the interface with a food item. Such elements often are used to promote browning and/or crisping of the surface of a food item (sometimes referred to as a "browning and/or crisping element"). When supported on a film or other substrate, such an element may be referred to as a "susceptor film" or, simply, "susceptor". In the example illustrated in FIG. 1A, a susceptor film 150 may overlie and be joined to at least a portion of any of panels 102, 104, 108, 112, 116, 120. If desired, the susceptor film may overlie substantially all of the panels of the blank and may substantially define the first side or surface of the blank. However, other microwave energy interactive elements, such as those described herein, are contemplated hereby.

For example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel, in the form of a solid "patch". The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil or high optical density evaporated material (collectively referred to as "segmented foil"), such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item.

In some instances, it may be beneficial to create one or more discontinuities or inactive regions to prevent overheating or charring of the construct. By way of example, and not limitation, in the construct 148 illustrated in FIGS. 1B-1H, panels 116 and 120 are partially overlapped. When exposed to microwave energy, the concentration of heat generated by the overlapped panels may be sufficient to cause the underlying support, in this case, paperboard, to become scorched. As such, the overlapping portions of one or both of the panels 116, 120 may be designed to be microwave inactive, for example, by forming these areas without a microwave energy interactive material or by deactivating the microwave energy interactive material in these areas.

Further still, one or more panels, portions of panels, or portions of the construct may be designed to be microwave energy inactive to ensure that the microwave energy is focused efficiently on the areas to be browned and/or crisped, rather than being lost to portions of the food item not intended to be browned and/or crisped or to the heating environment.

As stated above, any of the above elements and numerous others contemplated hereby may be supported on a substrate. The substrate typically comprises an electrical insulator, for example, a polymer film or other polymeric material. As used herein, the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a water vapor transmission rate as measured using ASTM F1249 of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195;

5,424,517; 5,410,135; 5,354,973; 5,340,436; 5,266,386; 5,260,537; 5221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The microwave interactive element or microwave interactive web may be joined to or overlie a dimensionally stable, microwave energy transparent support (hereinafter referred to as "microwave transparent support", "microwave inactive support" or "support") to form the construct.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions of the various blanks or other constructs described herein or contemplated hereby may be coated with varnish, clay, or other materials, either alone or in combination. The coating may then be printed over with product advertising or other information or images. The blanks or other constructs also may be coated to protect any information printed thereon.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. patent application Ser. No. 11/211,858, to Middleton, et al., titled "Absorbent Microwave Interactive Packaging", filed Aug. 25, 2005, both of which are incorporated herein by reference in their entirety. Additionally, the blanks or other constructs may include graphics or indicia printed thereon.

It will be understood that with some combinations of elements and materials, the microwave interactive element may have a grey or silver color this is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

It is contemplated that some food items to be heated, browned, and/or crisped may have an irregular surface. In such instances, the various blanks and constructs of the invention may include a microwave energy interactive element that conforms to the shape of the food item during heating. For example, if desired, a combination of paper layers, polymer film layers, and microwave interactive elements may be used to form a microwave energy interactive insulating material. As used herein, the terms "microwave energy interactive insulating material", "microwave energy interactive insulating structure", "microwave interactive insulating material", "microwave interactive structure", "insulating material", or "insulating structure" refer any arrangement or combination of layers of materials that is both responsive to microwave energy and capable of providing some degree of thermal insulation when used to heat a food item.

An insulating material may be used to form all or a portion of a construct in accordance with the present invention. The insulating material may comprise a patch that overlies a portion of one or more panels of a blank or construct, or may comprise a continuous or discontinuous layer that overlies all or a portion of one or more panels of a blank or construct. For example, all or a portion of the microwave energy interactive element indicated generally at 150 in FIG. 1A may comprise a microwave energy interactive insulating material.

In one aspect, the insulating material or structure comprises one or more susceptor layers in combination with one or more expandable insulating cells. Additionally, the insulating material may include one or more microwave energy transparent or inactive materials to provide dimensional stability, to improve ease of handling the microwave energy interactive material, and/or to prevent contact between the microwave energy interactive material and the food item. For example, an insulating material may comprise a microwave energy interactive material supported on a first polymer film layer, a moisture-containing layer superposed with the microwave energy interactive material, and a second polymer film layer joined to the moisture-containing layer in a predetermined pattern, thereby forming one or more closed cells between the moisture-containing layer and the second polymer film layer. The closed cells are adapted to expand or inflate in response to being exposed to microwave energy, thereby causing the microwave energy interactive structure to bulge and deform.

The various insulating materials may enhance heating, browning, and crisping of a food item in a microwave oven. First, the water vapor, air, and other gases contained in the closed cells provide insulation between the food item and the ambient environment of the microwave oven, thereby increasing the amount of sensible heat that stays within or is transferred to the food item. Additionally, the formation of the cells allows the material to conform more closely to the surface of the food item, placing the susceptor film in greater proximity to the food item, thereby enhancing browning and/or crisping. Furthermore, insulating materials may help to retain moisture in the food item when cooking in the microwave oven, thereby improving the texture and flavor of the food item. Additional benefits and aspects of such materials are described in PCT Publication No. WO 2003/66435, U.S. Pat. No. 7,019,271, and U.S. Patent Application Publication No. 20060113300 A1, each of which is incorporated by reference herein in its entirety.

Several exemplary insulating materials are depicted in FIGS. 2A-5C. It will be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 2A:
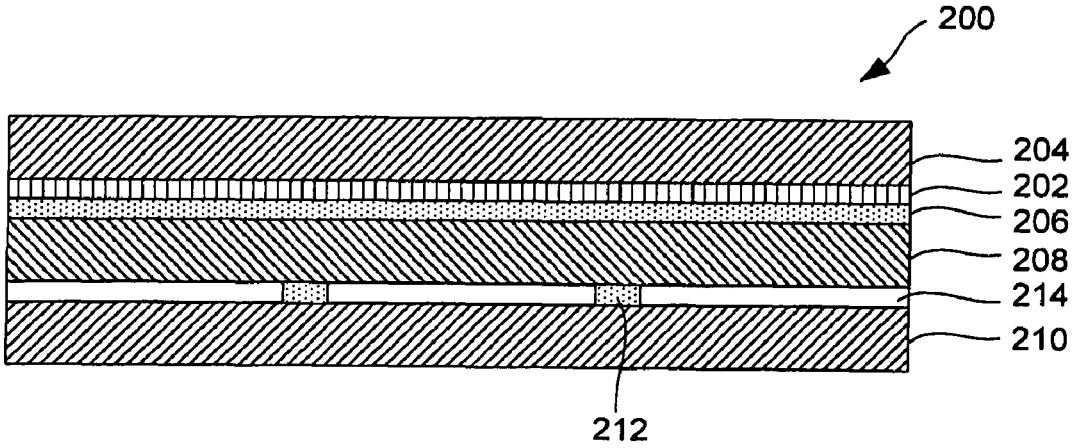
FIG. 2A is a schematic cross-sectional view of an exemplary microwave energy interactive insulating material that may be used to form a construct in accordance with various aspects of the present invention.
Figure 2B:
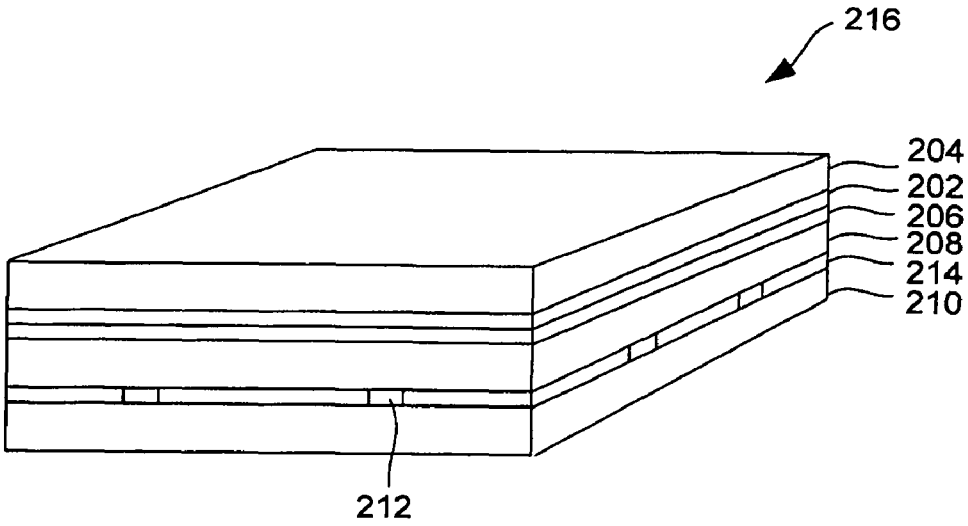
FIG. 2B schematically depicts the exemplary microwave energy interactive insulating material of FIG. 2A, in the form of a cut sheet.

FIG. 2A depicts an exemplary microwave energy interactive insulating material 200 that may be suitable for use with the various aspects of the invention. In this example, a thin layer of microwave energy interactive material that serves as a susceptor 202 is supported on a first polymer film 204 (collectively forming a "susceptor film") and bonded by lamination with an adhesive 206 (or otherwise) to a dimensionally stable substrate 208, for example, paper. The substrate 208 is bonded to a second polymer film 210 using a patterned adhesive 212 or other material, thereby forming a plurality of expandable insulating cells 214. The insulating material 200 may be cut and provided as a substantially flat, multi-layered sheet 216, as shown in FIG. 2B.

Figure 2C:
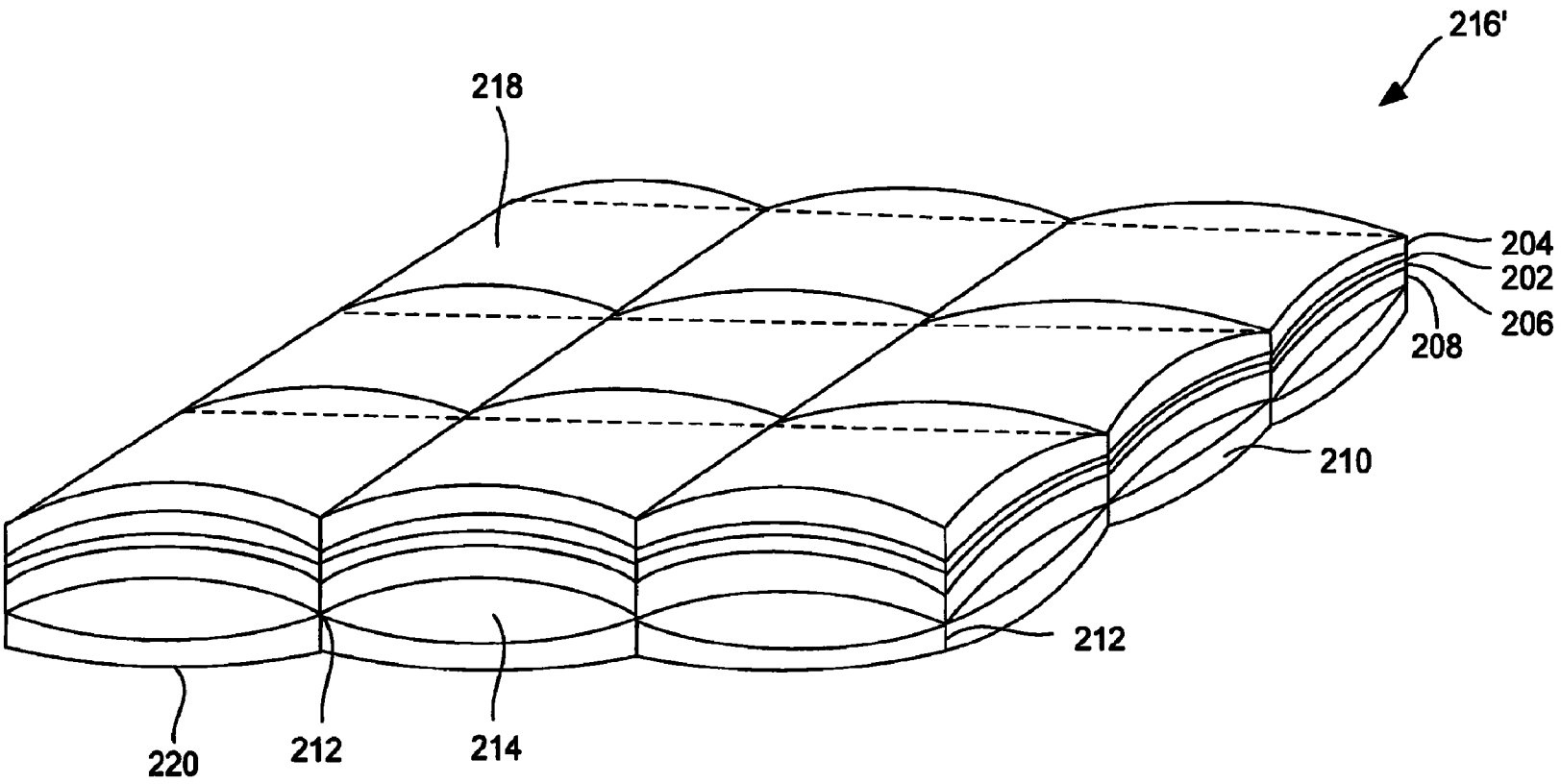
FIG. 2C schematically depicts the exemplary microwave energy interactive insulating sheet of FIG. 2B, upon sufficient exposure to microwave energy.

As the susceptor 202 heats upon impingement by microwave energy, water vapor and other gases typically held in the substrate 208, for example, paper, and any air trapped within the closed cells 214 between the second polymer film 210 and the substrate 208, expand, as shown in FIG. 2C. The resulting insulating material 216' has a quilted or pillowed or lofted top surface 218 and bottom surface 220. When microwave heating has ceased, the cells 214 typically deflate and the insulating structure returns to a somewhat flattened state.

Figure 2D:
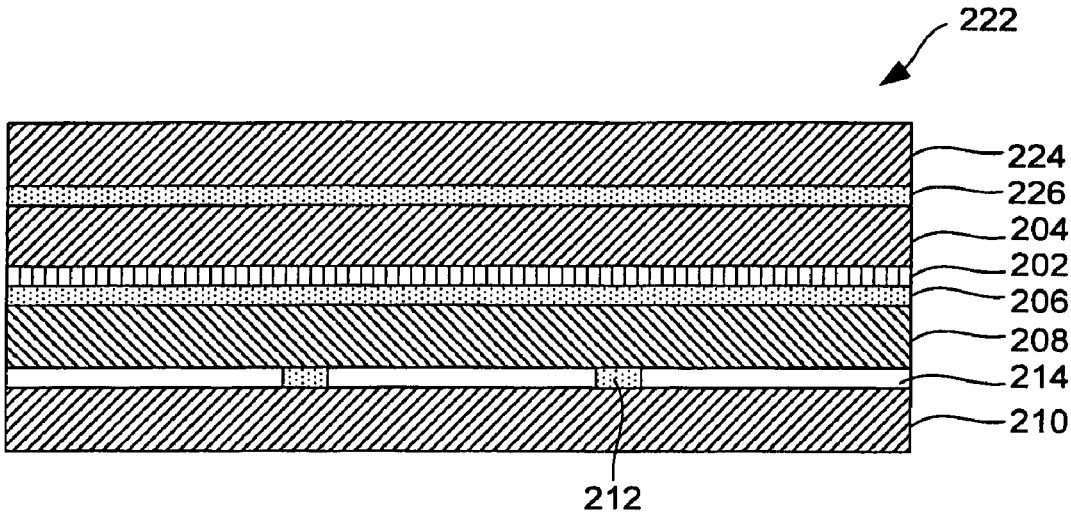
FIG. 2D is a schematic cross-sectional view of an exemplary variation of the microwave energy interactive insulating material of FIG. 2A.

If desired, the insulating material 200 may be modified to form a structure 222 that includes an additional paper or polymer film layer 224 joined to the first polymer film layer 204 using an adhesive 226 or other suitable material, as shown in FIG. 2D. The additional microwave transparent layer 224 may be a layer of paper, film, or any other suitable material, and may be provided to shield the food item (not shown) from any flakes of susceptor film that craze and peel away from the insulating material 216' during heating.

Figure 3:
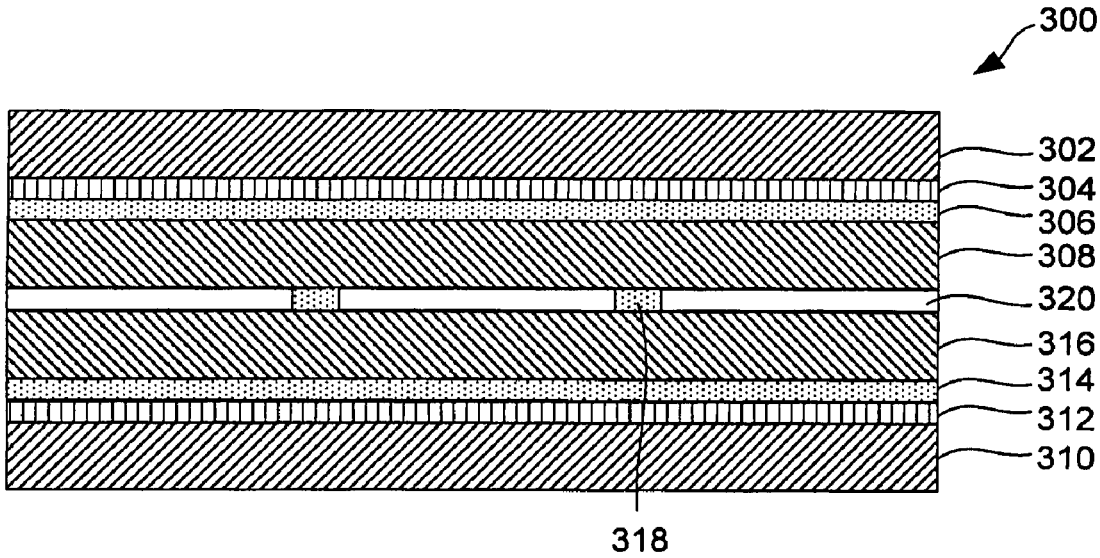
FIG. 3 is a schematic cross-sectional view of another exemplary microwave energy interactive insulating material that may be used to form a construct in accordance with various aspects of the invention.

FIG. 3 illustrates yet another exemplary insulating material 300 that may be suitable for use with the invention. In this example, the insulating material 300 includes a pair of adjoined, symmetrical layer arrangements. If desired, the two symmetrical arrangements may be formed by folding one layer arrangement onto itself.

The first symmetrical layer arrangement, beginning at the top of the drawing, comprises a polymer film layer 302, a susceptor layer 304, an adhesive layer 306, and a paper or paperboard layer 308. The adhesive layer 306 bonds the polymer film 302 and the susceptor layer 304 to the paperboard layer 308. The second symmetrical layer arrangement, beginning at the bottom of the drawing, also comprises a polymer film layer 310, a susceptor layer 312, an adhesive layer 314, and a paper or paperboard layer 316. A patterned adhesive layer 318 is provided between the two paper layers 308, 316, and defines a pattern of closed cells 320 configured to expand when exposed to microwave energy. By using an insulating material 300 having respective susceptors 304, 312 on each side of the expandable insulating cells 320, more heat is generated, thereby achieving greater expansion of the cells 320.

Figure 4:
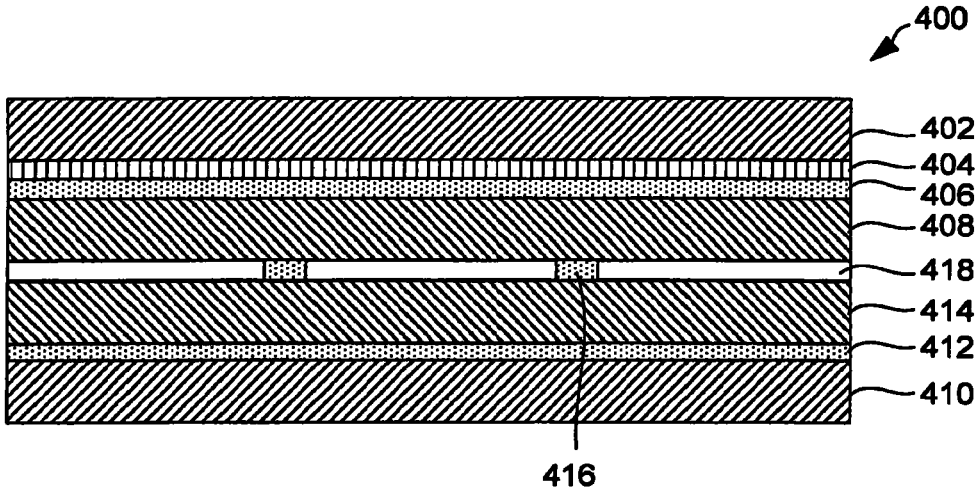
FIG. 4 is a schematic cross-sectional view of yet another exemplary microwave energy interactive insulating material that may be used to form a construct in accordance with various aspects of the invention.

FIG. 4 illustrates another exemplary insulating material 400. The material 600 includes a polymer film layer 402, a susceptor layer 404, an adhesive layer 406, and a paper layer 408. Additionally, the material 400 may include a second polymer film layer 410, an adhesive 412, and a paper layer 414. The layers may be adhered or affixed by a patterned adhesive 416 that defines a plurality of closed expandable cells 418.

It will be recognized that each of the exemplary insulating materials depicted in FIGS. 2A-4 include a moisture-containing layer (e.g. paper) that is believed to release at least a portion of the vapor that inflates the expandable cells. However, it is contemplated that structures that are adapted to inflate without such moisture-containing layers also may be used in accordance with the invention.

Figure 5A:
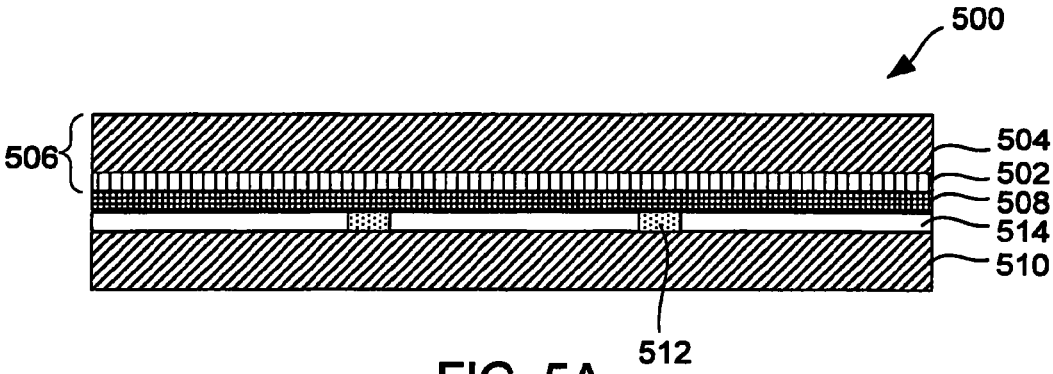
FIG. 5A is a schematic cross-sectional view of still another exemplary microwave energy interactive insulating material that may be used to form a construct in accordance with various aspects of the invention.

FIG. 5A illustrates one example of an expandable cell insulating material 500 that is adapted to inflate without the use of a moisture-containing layer, for example, paper. In this example, one or more reagents are used to generate a gas that expands the cells of the insulating material. For example, the reagents may comprise sodium bicarbonate ($NaHCO_3$) and a suitable acid. When exposed to heat, the reagents react to produce carbon dioxide. As another example, the reagent may comprise a blowing agent. Examples of blowing agents that may be suitable include, but are not limited to, p-p'-oxybis (benzenesulphonylhydrazide), azodicarbonamide, and p-toluenesulfonylsemicarbazide. However, it will be understood that numerous other reagents and released gases are contemplated hereby.

Figure 5B:
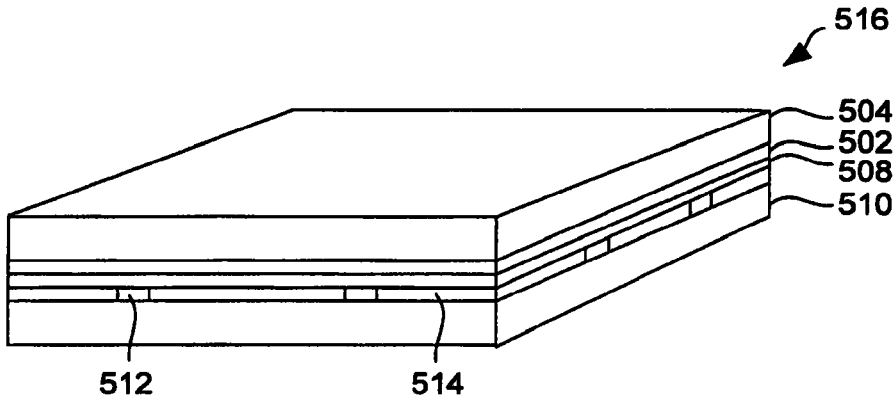
FIG. 5B schematically depicts the exemplary microwave energy interactive insulating material of FIG. 5A, in the form of a cut sheet.

In the example shown in FIG. 5A, a thin layer of microwave interactive material 502 is supported on a first polymer film 504 to form a susceptor film 506. One or more reagents 508, optionally within a coating, lie adjacent at least a portion of the layer of microwave interactive material 502. The reagent 508 coated susceptor film 506 is joined to a second polymer film 510 using a patterned adhesive 512 or other material, or using thermal bonding, ultrasonic bonding, or any other suitable technique, such that closed cells 514 (shown as a void) are formed in the material 500. The material 500 may be cut into a sheet 516, as shown in FIG. 5B.

Figure 5C:
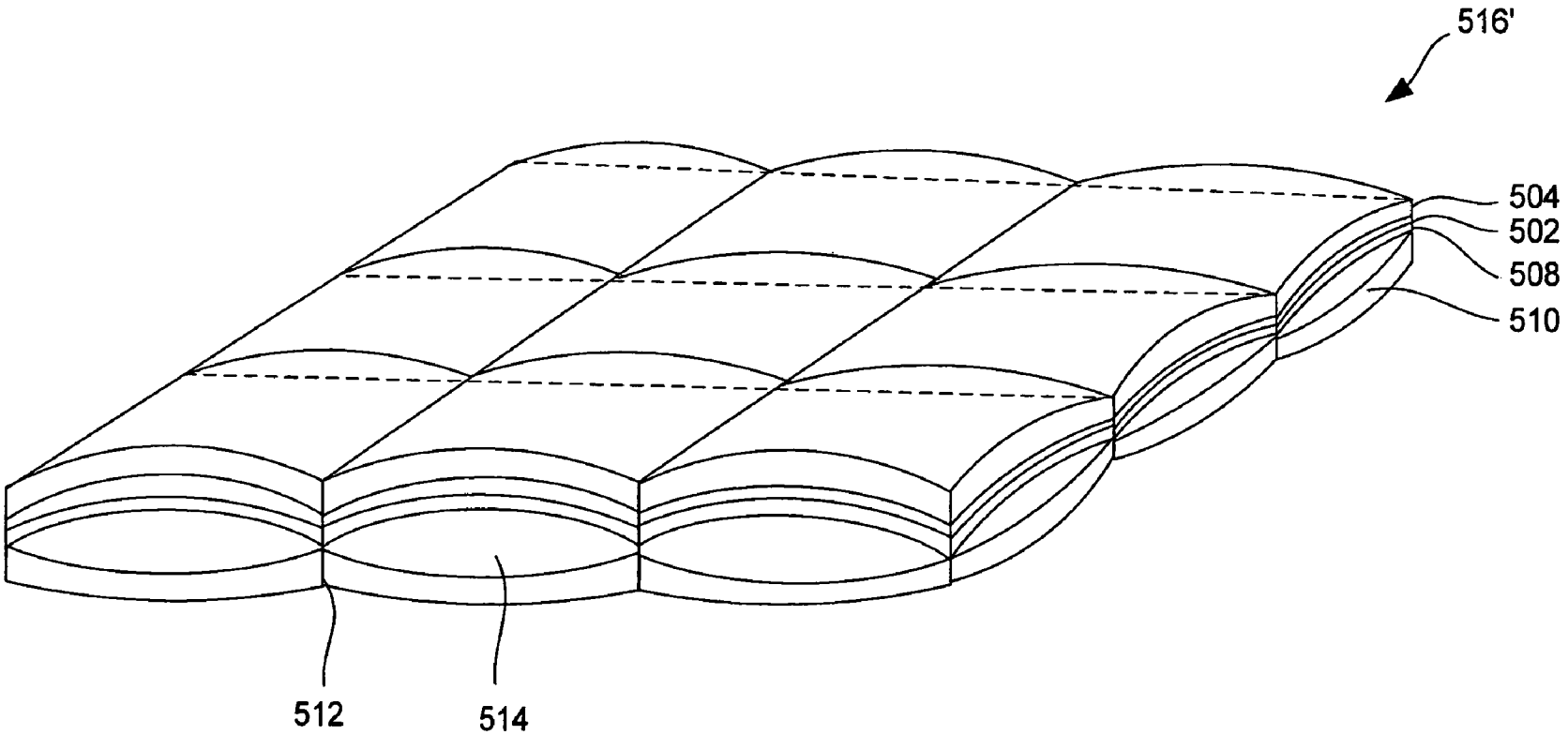
FIG. 5C schematically depicts the exemplary microwave energy interactive insulating sheet of FIG. 5B, upon sufficient exposure to microwave energy.

As discussed in connection with the other exemplary insulating materials, as the microwave interactive material 502 heats upon impingement by microwave energy, water vapor or other gases are released from or generated by the reagent 508. The resulting gas applies pressure on the susceptor film 506 on one side and the second polymer film 510 on the other side of the closed cells 514. Each side of the material 500 reacts simultaneously, but uniquely, to the heating and vapor expansion to form a pillowed or quilted insulating material 516' (FIG. 5C). This expansion may occur within 1 to 15 seconds in an energized microwave oven, and in some instances, may occur within 2 to 10 seconds. Even without a paper or paperboard layer, the water vapor resulting from the reagent is sufficient both to inflate the expandable cells and to absorb any excess heat from the microwave energy interactive material. Such materials are described further in U.S. Patent Application Publication No. 20060289521A1, which is incorporated by reference herein in its entirety.

Typically, when microwave heating has ceased, the cells or quilts may deflate and return to a somewhat flattened state. Alternatively, the insulating material may comprise a durably expandable microwave energy interactive insulating material. As used herein, the term "durably expandable microwave energy interactive insulating material" or "durably expandable insulating material" refers to an insulating material that includes expandable cells that tend to remain at least partially, substantially, or completely inflated after exposure to microwave energy has been terminated. Such materials may be used to form multi-functional packages and other constructs that can be used to heat a food item, to provide a surface for safe and comfortable handling of the food item, and to contain the food item after heating. Thus, a durably expandable insulating material may be used to form a package or construct that facilitates storage, preparation, transportation, and consumption of a food item, even "on the go".

In one aspect, a substantial portion of the plurality of cells remain substantially expanded for at least about 1 minute after exposure to microwave energy has ceased. In another aspect, a substantial portion of the plurality of cells remain substantially expanded for at least about 5 minutes after exposure to microwave energy has ceased. In still another aspect, a substantial portion of the plurality of cells remain substantially expanded for at least about 10 minutes after exposure to microwave energy has ceased. In yet another aspect, a substantial portion of the plurality of cells remain substantially expanded for at least about 30 minutes after exposure to microwave energy has ceased. It will be understood that not all of the expandable cells in a particular construct or package must remain inflated for the insulating material to be considered to be "durable". Instead, only a sufficient number of cells must remain inflated to achieve the desired objective of the package or construct in which the material is used.

For example, where a durably expandable insulating material is used to form all or a portion of a package or construct for storing a food item, heating, browning, and/or crisping the food item in a microwave oven, removing it from the microwave oven, and removing it from the construct, only a sufficient number of cells need to remain at least partially inflated for the time required to heat, brown, and/or crisp the food item and remove it from the microwave oven after heating. In contrast, where a durably expandable insulating material is used to form all or a portion of a package or construct for storing a food item, heating, browning, and/or crisping the food item in a microwave oven, removing the food item from the microwave oven, and consuming the food item within the construct, a sufficient number of cells need to remain at least partially inflated for the time required to heat, brown, and/or crisp the food item, remove it from the microwave oven after heating, and transport the food item until the food item and/or construct has cooled to a surface temperature comfortable for contact with the hands of the user.

Any of the durably expandable insulating materials of the present invention may be formed at least partially from one or more barrier materials, for example, polymer films, that substantially reduce or prevent the transmission of oxygen, water vapor, or other gases from the expanded cells. Examples of such materials are described above. However, the use of other materials is contemplated hereby.

Furthermore, any of the microwave energy interactive insulating materials described herein or contemplated hereby may include an adhesive pattern or thermal bond pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item.

If desired, multiple layers of insulating materials and/or other microwave energy interactive elements may be used to enhance the insulating properties of the insulating material and, therefore, enhance the browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating material may be arranged so that their respective susceptor film layers are facing away from each other. In another example, two sheets of an insulating material may be arranged so that their respective susceptor film layers are facing towards each other. In still another example, multiple sheets of an insulating material may be arranged in a like manner and superposed. In a still further example, multiple sheets of various insulating materials are superposed in any other configuration as needed or desired for a particular application. Thus, for example, an insulating material may be superposed with one or more additional layers of susceptors or susceptor films.

Various aspects of the invention may be understood by way of the following example, which is not to be construed to be limiting in any manner.

EXAMPLE

Figure 1H:
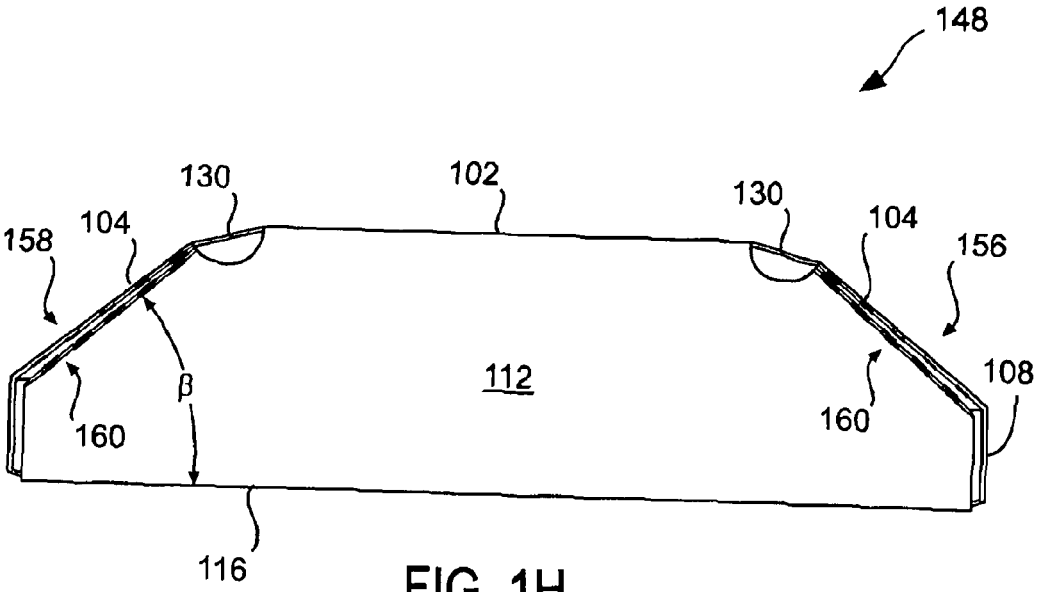
FIG. 1H schematically depicts a side view of the exemplary construct of FIG. 1G.

A carton 148 as illustrated in FIGS. 1G and 1H was constructed. The carton accommodated a baguette-shaped bread snack food product. The construct had a height of about 42 mm, a length across the side panel 112 of 174 mm, and a width across the construct end of about 65 mm. The construct was formed from a metallized polyethylene terephthalate susceptor film joined to one side of a sheet of paperboard. The angle of inclination of the upper end panels 20 was about 48 degrees. Fold lines 136, 138, 142 were cut-space lines with 100% cuts.

While specific examples of blanks are provided herein, it will be understood that numerous suitable shapes and configurations of panels may be used to form a construct according to the invention. Examples of other shapes encompassed hereby include, but are not limited to, squares, polygons, circles, ovals, or any other regular or irregular shape. The shape of each panel may be determined by the shape of the food item, and it should be understood that different packages are contemplated for different food items, for example, egg rolls, spring rolls, taquitos, burritos, sandwiches, pizzas, French fries, soft pretzels, pizza bites, cheese sticks, pastries, doughs, and so forth.

Likewise, while various examples of constructs are provided herein, it will be understood that any configuration of components may be used as needed or desired. The construct may be flexible, semi-rigid, rigid, or may include a variety of components having different degrees of flexibility. Additionally, it should be understood that the present invention contemplates constructs for single-serving portions and for multiple-serving portions. It also should be understood that various components used to form the constructs of the present invention may be interchanged. Thus, while only certain combinations are illustrated herein, numerous other combinations and configurations are contemplated hereby.

It also will be understood that in each of the various blanks and constructs described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness, a cut that extends partially into a material along the desired line of weakness, and/or a series of cuts that extend partially into and/or completely through the material along the desired line of weakness; and various combinations of these features.

Although certain embodiments of this invention have been described with a certain degree of particularity, those skilled in the art could make numerous alterations to the disclosed embodiments without departing from the spirit or scope of this invention. Any directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A blank for forming a construct, comprising:

a top panel having a first dimension extending along a first direction and a second dimension extending along a second direction, the first direction being crosswise to the second direction;

a first upper end panel and a second upper end panel connected to the top panel along respective fold lines extending in the second direction;

a first lower end panel and a second lower end panel connected respectively to the first upper end panel and the second upper end panel along respective fold lines extending in the second direction;

a first end closure flap and a second end closure flap connected respectively to the first lower end panel and the second lower end panel along respective fold lines extending in the second direction;

a first side panel and a second side panel foldably connected to the top panel along respective fold lines extending in the first direction;

a pair of closure tabs connected to opposite ends of the first side panel and the second side panel along respective fold lines extending in the second direction;

a plurality of corner closures including a first corner closure extending between the first upper end panel and the first side panel, wherein the first corner closure comprises a first tuck-in panel foldably connected to the first upper end panel along a fold line that extends in the first direction, a second tuck-in panel foldably connected to the first side panel along a fold line that extends obliquely to each of the first direction, the second direction and the fold line along which first tuck-in panel is foldably connected to the first upper end panel, and a fold line along which the first and second tuck-in panels are connected to one another, wherein the fold line along which the first and second tuck-in panels are connected to one another extends obliquely to each of the first direction, the second direction.

the fold line along which the first tuck-in panel is foldably connected to the first upper end panel, and the fold line along which the second tuck-in panel is foldably connected to the first side panel; and at least one bottom panel foldably connected to the first side panel along a fold line extending in the first direction.

2. The blank of claim 1, wherein the bottom panel has a first dimension extending along the first direction and a second dimension extending along the second direction, the first dimension of the bottom panel is greater than the second dimension of the top panel, and the second dimension of the bottom panel is equal to the second dimension of the top panel.

3. The blank of claim 1, wherein the bottom panel is a first bottom panel, and the blank further comprises a second bottom panel foldably connected to the second side panel along a fold line extending in the first direction.

4. The blank of claim 1, wherein the plurality of corner closures includes a second corner closure extending between the first upper end panel and the second side panel, a third corner closure extending between the second upper end panel and the first side panel, and a fourth corner closure extending between the second upper end panel and the second side panel; and for each corner closure of the second, third and fourth corner closures, the corner closure includes a first tuck-in panel and a second tuck-in panel that are connected to one another by, and partially defined by, an oblique fold line.

5. The blank of claim 1, further comprising a plurality of cut-outs extending through the blank, at least one of the cut-outs being positioned at an intersection of the top panel, the first upper end panel, the first corner closure, and the first side panel, wherein the at least one of the cut-outs is defined in, and extends through, at least one panel selected from the group consisting of the top panel, the first upper end panel, and the first side panel.

6. The blank of claim 1, further comprising a microwave energy interactive element overlying at least a portion of at least one of the top panel, the first upper end panel, the second upper end panel, the first side panel, the second side panel, the first lower end panel, and the second lower end panel.

7. The blank of claim 6, wherein the microwave energy interactive element is selected from the group consisting of a susceptor, a segmented metal foil, a metal foil patch, a microwave energy interactive insulating material, and any combination thereof.

8. The blank of claim 4, comprising each of the second corner closure, third corner closure, and fourth corner closure being connected to the respective first upper end panel or second upper end panel along a respective fold line extending in the first direction, and each of the second corner closure, third corner closure, and fourth corner closure being connected to the respective first side panel or second side panel along a respective oblique fold line.

9. The blank of claim 8, further comprising a plurality of cut-outs extending through the blank, the plurality of cut-outs including a first cut-out disposed between the top panel and the first corner closure, a second cut-out disposed between the top panel and the second corner closure, a third cut-out disposed between the top panel and the third corner closure, and a fourth cut-out disposed between the top panel and the fourth corner closure.

10. A construct for receiving a food item, comprising:

a top panel including first and second edges that are opposite from one another, and third and fourth edges that are opposite from one another;

a bottom panel that is spaced apart from the top panel so that an interior of the construct is positioned between the top and bottom panels, the bottom panel having opposite first and second edges;

a first side panel foldably connected to both the first edge of the top panel and the first edge of the bottom panel, so that the first side panel extends from the first edge of the top panel to the first edge of the bottom panel;

a second side panel that is spaced apart from the first side panel so that the interior of the construct is positioned between the first and second side panels, the second side panel being foldably connected to both the second edge of the top panel and the second edge of the bottom panel, so that the second side panel extends from the second edge of the top panel to the second edge of the bottom panel;

a first end closure at a first end of the construct; and a second end closure at a second end of the construct, wherein the first end closure includes a first upper end panel foldably connected to the third edge of the top panel, wherein the first upper end panel is disposed at an acute angle of inclination with respect to the bottom panel, a first lower end panel foldably connected to the first upper end panel, a first closure flap foldably connected to the first lower end panel, the first closure flap being in a facing, contacting relationship with the bottom panel, and a pair of corner closures foldably connected to respective opposed sides of the first upper end panel and the first side panel and the second side panel, respectively; and a pair of closure tabs connected to opposite ends of the first side panel, the closure tabs being in a facing relationship with the first lower end panel.

11. The construct of claim 10, wherein each corner closure comprises a pair of tuck-in panels folded in an overlapping configuration with one another.

12. The construct of claim 10, wherein the first side panel is connected to one of the corner closures along an edge of the first side panel, and the edge of the first side panel has an angle of inclination that generally conforms with the angle of inclination of the first upper end panel.

13. The construct of claim 10, further comprising at least one cut-out positioned at an intersection of the top panel, the first upper end panel, the first corner closure, and the first side panel, wherein the at least one cut-out is defined in, and extends through, at least one panel selected from the group consisting of the top panel, the first upper end panel, and the first side panel.

14. The construct of claim 10, wherein the second end closure comprises:

a second upper end panel;

a pair of corner closures foldably connected to respective opposed sides of the second upper end panel, the corner closures of the second end closure each being foldably connected to a respective one of the side panels; and a second lower end panel foldably connected to a lower edge of the second upper end panel, wherein each corner closure comprises a pair of tuck-in panels folded in an overlapping configuration with one another.

15. The construct of claim 10, further comprising a microwave energy interactive element overlying at least a portion of at least one of the top panel, first side panel, second side panel, and bottom panel.

16. The construct of claim 15, wherein the microwave energy interactive element is selected from the group consisting of a susceptor, a segmented metal foil, a metal foil patch, a microwave energy interactive insulating material, and any combination thereof.

17. The construct of claim 10, wherein for each corner closure, the corner closure extends from an edge of the first upper end panel, and the corner closure includes a first tuck-in panel and a second tuck-in panel defined by a plurality of oblique fold lines extending away from the top panel.

18. The blank of claim 1, wherein the fold line along which the first tuck-in panel is foldably connected to the first upper end panel is aligned with the fold line along which the first side panel is connected to the top panel.

19. The blank of claim 1, further comprising:

closure cuts respectively positioned at opposite ends of the fold line along which the first end closure flap is connected to the first lower end panel; and closure cuts respectively positioned at opposite ends of the fold line along which the second end closure flap is connected to the second lower end panel.

20. The blank of claim 3, wherein the second bottom panel is an adhesive panel.

21. The blank of claim 5, wherein the at least one of the cut-outs is defined in, and extends through, each of the top panel, the first upper end panel, and the first side panel.

22. The construct of claim 10, wherein while the construct is fully erected:

the first side panel, as a whole, is planar such that the first side panel is coplanar with a first plane, and each of the first edge of the top panel and the first edge of the bottom panel extends in the first plane, and the second side panel, as a whole, is planar such that the second side panel is coplanar with a second plane, and each of the second edge of the top panel and the second edge of the bottom panel extends in the second plane.

23. The construct of claim 10, wherein the first end closure further includes a pair of closure cuts disposed between the first closure flap and the first lower end panel, and the closure tabs are engaging the closure cuts to maintain the first end closure in a closed configuration.

24. The construct of claim 13, wherein the at least one cut-out is defined in, and extends through, each of the top panel, the first upper end panel, and the first side panel.

* * * * *